US005330267A

United States Patent [19]

Tauscher

[11] Patent Number: 5,330,267

[45] Date of Patent: Jul. 19, 1994

[54] STATIONARY FLUID MIXER WITH FLUID GUIDE SURFACES

[75] Inventor: Willy Tauscher, Winterthur, Switzerland

[73] Assignee: Gebrueder Sulzer Aktiengesellschaft, Winterthur, Switzerland

[21] Appl. No.: 983,434

[22] Filed: Dec. 2, 1992

[30] Foreign Application Priority Data

Dec. 10, 1991 [CH] Switzerland ..... 03632/91-0

[51] Int. Cl.[5] ..... B01F 5/00

[52] U.S. Cl. ..... 366/336; 366/337; 366/340

[58] Field of Search ..... 366/336, 337, 338, 340, 366/341; 138/38, 37, 40, 42

[56] References Cited

U.S. PATENT DOCUMENTS

| | | | |
|---|---|---|---|
| 3,190,618 | 6/1965 | Katzen | 366/337 |
| 4,164,375 | 8/1979 | Allen | 366/337 |
| 4,461,579 | 7/1984 | McCallum | 366/337 |
| 4,498,786 | 2/1985 | Ruscheweyh | 366/336 |
| 4,643,584 | 2/1987 | Allocca | 366/337 |
| 4,929,088 | 5/1990 | Smith | 366/336 |
| 4,981,368 | 1/1991 | Smith | 366/337 |

FOREIGN PATENT DOCUMENTS

| | | | |
|---|---|---|---|
| 919724 | 4/1982 | U.S.S.R. | 366/338 |

*Primary Examiner*—Stephen F. Gerrity
*Assistant Examiner*—Patrick F. Brinson
*Attorney, Agent, or Firm*—Townsend & Townsend Khourie & Crew

[57] ABSTRACT

A stationary fluid mixer in a flow conduit (7) has at least two baffle plates (10) secured to the wall of the conduit. The baffle plates are wider on the inside of the flow conduit than along the conduit wall, and they form an angle W of 10° to 45° relative to the main flow direction Z. The baffle plates can be given different orientations, and the projection FZ of the baffle plates in the main flow direction through the conduit is between 5° to 30° of the conduit cross-section F. This provides efficient mixing of the fluid in a simple manner.

8 Claims, 4 Drawing Sheets

STATIONARY FLUID MIXER WITH FLUID GUIDE SURFACES

BACKGROUND OF THE INVENTION

The invention concerns a stationary fluid mixer with at least two guide surfaces or baffles for use in a flow conduit. Simple stationary mixers with baffles are known, but they provide only limited mixing and homogenization and always result in relatively large pressure drops. More intricate stationary mixers; for example, those employing intersecting subchannels made of plates (available as "Sulzer SMV mixer"), have very good mixing properties, but they are often relatively expensive to manufacture.

SUMMARY OF THE INVENTION

Therefore, the goal of the present invention is to effect good mixing in a simple manner while generating relatively low pressure drops. This problem is solved according to the present invention by mounting baffle plates walls of a channel or conduit for the fluid, which is simple and mechanically stable. To cause flow around the front and rear sides of the baffle plates with the lowest possible pressure drop, the plates are relatively narrower in the vicinity of the wall than in the interior of the conduit, and efficient deflection and turbulence take place at the same time in the direction of the angle W.

By differently orienting a few baffle plates, intersecting, radially oriented subflows are created for especially good mixing in the simplest possible way. A projection FZ of the baffle plates in the flow direction should only be 5% to 30% of the cross-section of the conduit, and thus an optimum mixing effect can be achieved at relatively low cost and with a small pressure drop. The baffle plates may be trapezoidal or rounded, and they can be offset with respect to each other and distributed essentially uniformly over the entire cross-section of the conduit. Neighboring or successive baffles plates can be offset with respect to each other or they may be arranged so they are twisted with respect to the main flow direction Z through the conduit and a line N normal (perpendicular) to the conduit wall.

DETAILED DESCRIPTION OF THE PREFERRED EMBODIMENT

Figure 1A:
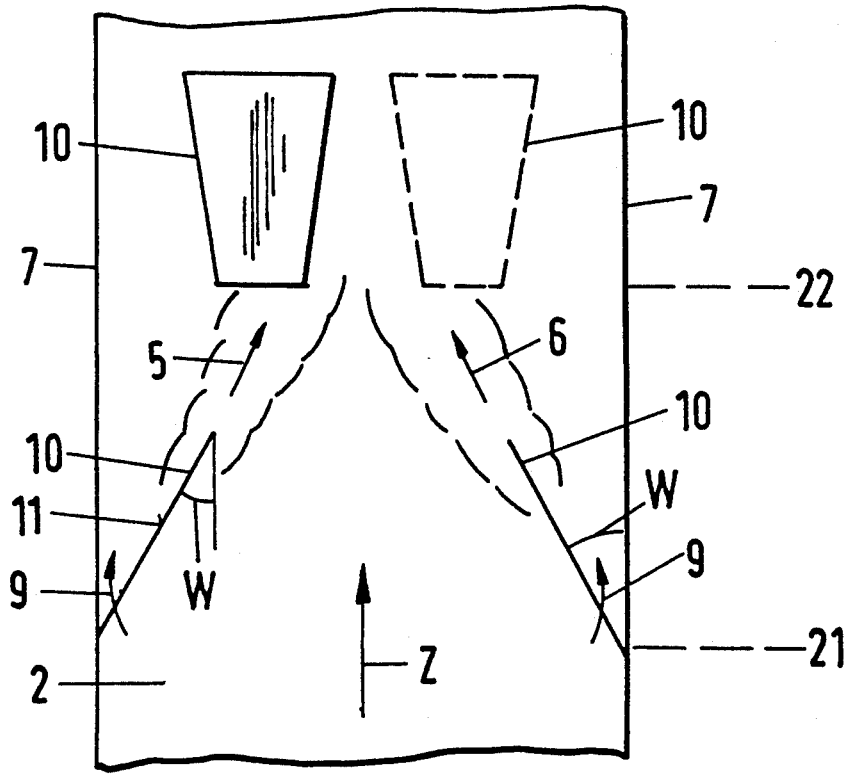
FIGS. 1*a* and 1*b* show a mixer according to the present invention with two baffle plates in one cross-sectional plane.

FIG. 1 shows a mixer constructed according to the present invention having two baffle plates 10 mounted on the wall of a flow conduit 7 in a first cross-sectional plane 21 (two views). The trapezoidal baffle plates 10 become wider toward the interior of the conduit. The baffle plate width A at the wall of conduit 7 is smaller than its width B in the interior of the conduit. Therefore, a better flow over downstream facing sides of baffle plates in the direction of arrows 9 is achieved.

Figure 1B:
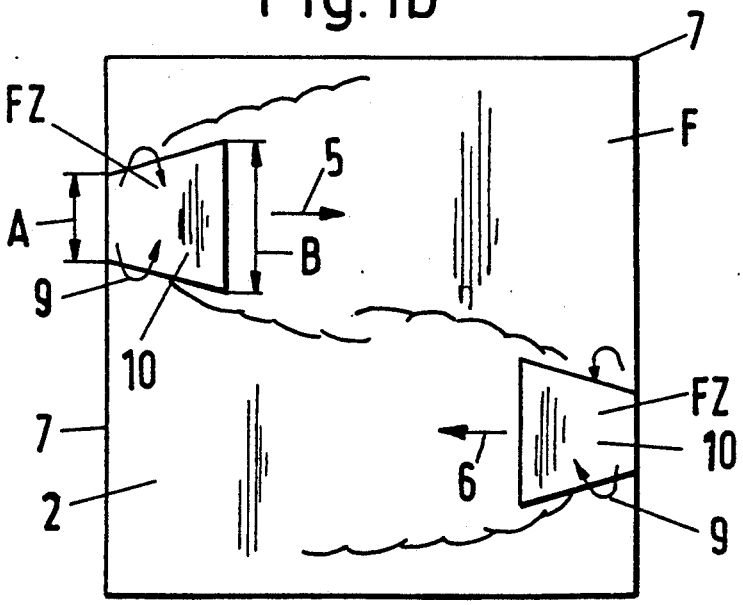

Baffle plates 10 are offset with respect to each other and are oriented at an angle W of 30°, for example, relative to the main flow direction Z of fluid 2. The baffle plates generate corresponding flow cones deflected in directions 5, 6, which result in intensive mixing. Cross-currents produced by the offset baffle plates are especially effective. The projection FZ of the baffles plates in the flow direction Z is less than 30% of the cross-sectional area F of the flow conduit (FIG. 1*b*). With an FZ component of 10% to 20% of F, for example, turbulent intense mixing currents can be created. In a next, second cross-sectional plane 22, there are two further baffles plates 10 which are offset relative to the baffle plates in the first cross-sectional plane 21 to provide added intense mixing of the subcurrents of the individual baffle plates 10. Known baffle plates that are narrower at the interior of the conduit can also be arranged in an offset manner, but, as explained, this would result in relatively poorer flow over the rear or downstream sides of the plates.

Figure 2A:
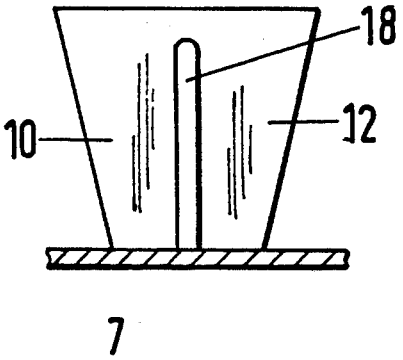
FIGS. 2*a* to 2*d* show different shapes and orientations of baffle plates.
Figure 2B:
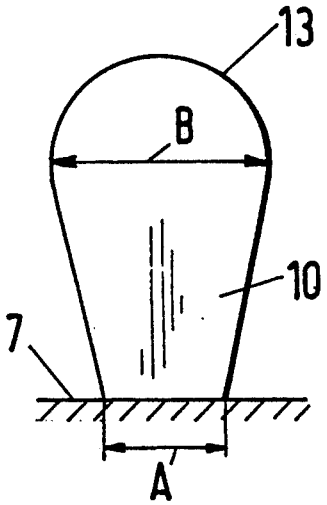
Figure 2C:
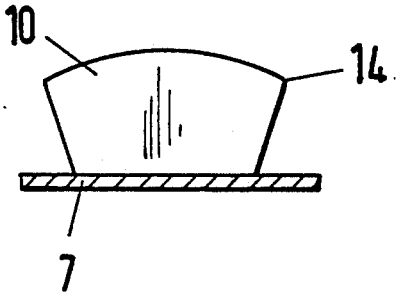
Figure 2D:
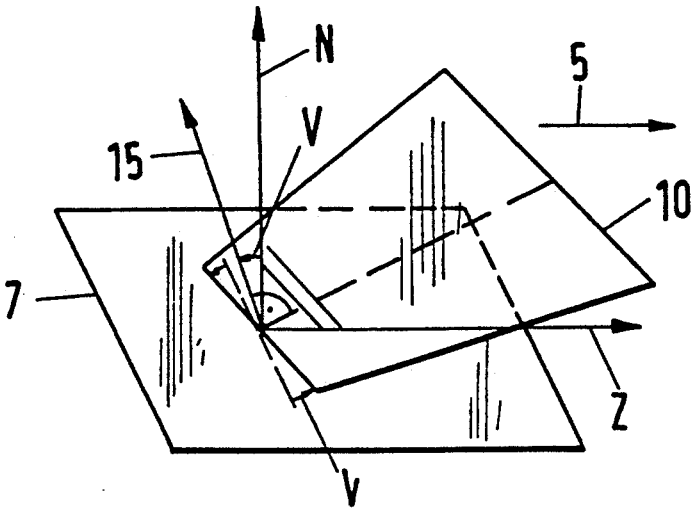
Figure 3:
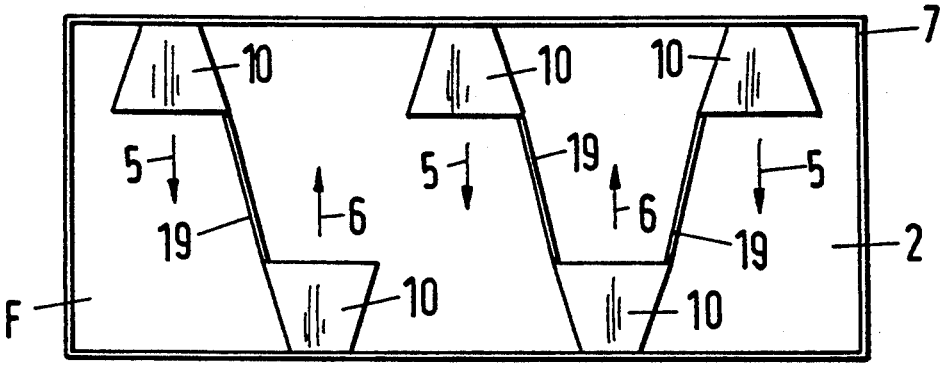
FIG. 3 shows an embodiment with several baffle plates distributed uniformly over the cross-section of a flow conduit.
Figure 4:
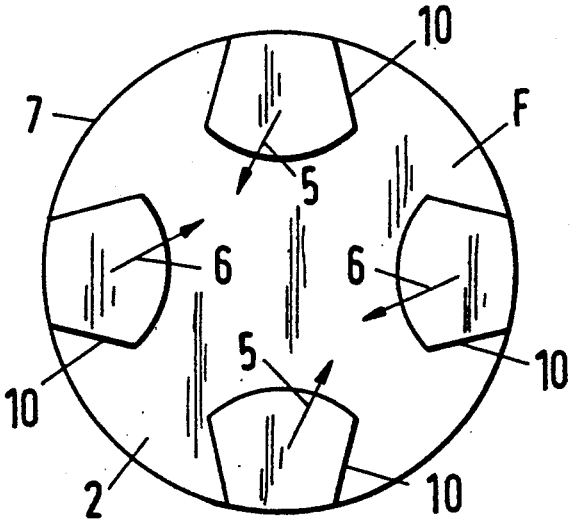
FIG. 4 shows an embodiment of twisted baffle plates in a round flow conduit.

FIGS. 2*a* to 2*c* show baffle plates 10 with different possible shapes. For example, the baffle plate may be a trapezoidal plate 12, a rounded plate 13 or a combination shape as illustrated by plate 14. The baffle plates may also have different sizes and other shapes. The baffle plates can also be made so they are split, bent, curved or twisted. The baffle plates may be provided with reinforcements; e.g. in the form of a rib 18 as shown in FIG. 2*a*, especially for high flow speeds and high loads. Opposing baffle plates can be connected to structures with a latticework such as struts 19 shown in FIG. 3. This shows an embodiment with several baffle plates 10 distributed uniformly over the entire cross-section F of the conduit with subflows 5, 6, and the cross-currents created by them, oriented alternately up and down (as seen in the FIGURE). FIG. 2*d* shows a baffle plate 10 arranged so it is twisted relative to the main flow direction Z and the normal N to the wall conduit 7. In other words, normal 15 of baffle plate 10 is not in plane Z, N. It is twisted in the direction V. FIG. 4 shows another embodiment with baffle plates 10 in a twisted arrangement in a round flow conduit 7. These twisted baffle plates also produce intersecting subflows; e.g. in directions 5, 6 that do not run radially. A slight twisting of baffle plates 10 significantly improves the flow over rear side 11.

Figure 5A:
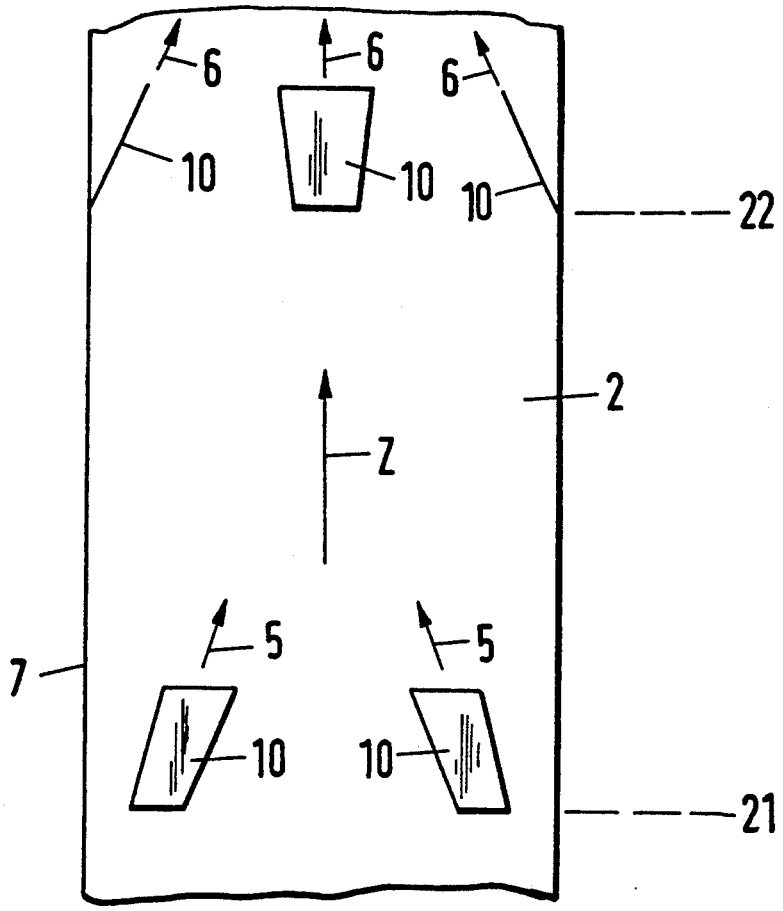
FIGS. 5*a* and 5*b* show, in two cross-sectional planes of the flow conduit, an embodiment with offset baffle plates.
Figure 5B:
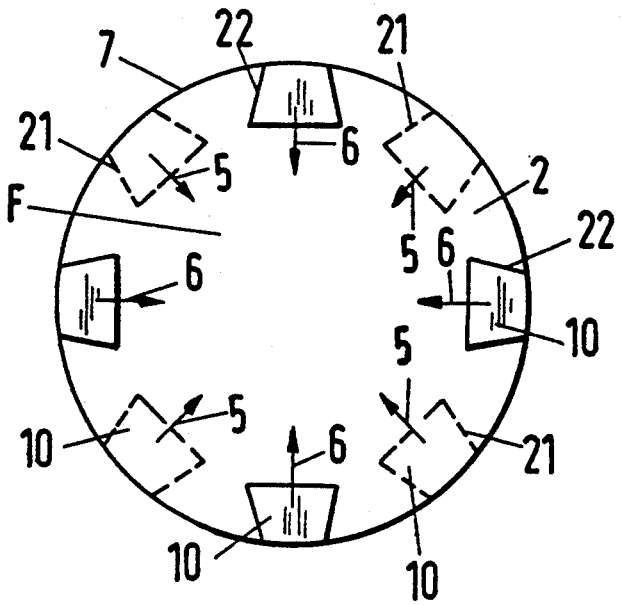

FIG. 5 shows a mixer with baffle plates in two cross-sectional planes 21, 22. The baffle plates of plane 22 are offset with respect to those of the first plane 21. In this embodiment, the baffle plates produce a radial subflow that also has an intense mixing effect. Mixers having baffle plates in several planes will have a secondary mixing zone when the distance between the planes is relatively large.

What is claimed is:

1. A stationary fluid mixer in a fluid flow conduit having a flow in the direction of an axis extending centrally of said conduit comprising:

a plurality of baffle plates secured to a wall of the conduit and obstructing fluid flow from said conduit wall to and toward the center of the conduit, each said baffle plate extending from the wall towards an interior of the conduit, each said baffle plate having a width at an end thereof in the interior of the conduit which is greater than a width of the baffle plate at the point of attachment to the conduit wall, the baffle plates forming an angle relative to a fluid medium flow direction through the conduit of 10° to 45°;

at least two of said baffle plates disposed at a first cross section of said conduit substantially normal to the direction of flow, said first cross section constituting a first spaced apart plane;

at least two other of said baffle plates disposed at a second cross section of said conduit substantially normal to the direction of flow, said second cross section constituting a second spaced apart plane from said first cross section;

said baffles of said first cross section being offset so as to not overlie said baffles of said second cross section when said spaced apart planes are registered one to another in the direction of flow whereby said fluid passing in the direction of flow encounters baffles in staggered relationship when flow through said conduit.

2. A stationary mixing element according to claim 1 wherein adjacent baffles plates at said cross sections have differing orientations arranged so that projections of the surfaces of said baffle plates intersect.

3. A stationary mixer according to claim 1 wherein the baffle plates have a projection in the flow direction which is about 5% to 30% of the cross-section of the conduit.

4. A stationary mixer according to claim 1 wherein the baffle plates have a trapezoidal shape.

5. A stationary mixer according to claim 1 wherein the baffle plates have a rounded shape.

6. A stationary mixer according to claim 1 including a holder securing the baffle plates to the conduit wall.

7. A stationary mixer according to claim 1 wherein the baffle plates are substantially uniformly distributed over said cross-sectional areas of the conduit.

8. A stationary mixer according to claim 1 wherein the baffle plates have a twisted shape with respect to the flow direction and a line which is perpendicular to the conduit wall.

* * * * *